United States Patent [19]

Greaves

[11] Patent Number: 4,832,236

[45] Date of Patent: May 23, 1989

[54] PRESSURIZABLE CONTAINERS

[75] Inventor: James R. Greaves, Wantage, England

[73] Assignee: Metal Box Public Limited Company, Reading, England

[21] Appl. No.: 210,144

[22] Filed: Jun. 15, 1988

Related U.S. Application Data

[63] Continuation of Ser. No. 133,242, Dec. 10, 1987, abandoned, which is a continuation of Ser. No. 17,040, Feb. 19, 1987, abandoned, which is a continuation of Ser. No. 728,743, Apr. 30, 1985, filed as PCT GB84/00289 on Aug. 20, 1984, abandoned.

[30] Foreign Application Priority Data

Aug. 31, 1983 [GB] United Kingdom ..... 8323315

[51] Int. Cl.[4] ..... B65D 83/14

[52] U.S. Cl. ..... 222/402.1; 222/542; 413/7; 413/62; 53/470; 53/488

[58] Field of Search ..... 222/402.1, 402.21–402.25, 222/542; 413/7, 42–44, 58–62; 53/470, 330, 488–489

[56] References Cited

U.S. PATENT DOCUMENTS

| | | | |
|---|---|---|---|
| 3,095,122 | 6/1963 | Lewiecki et al. | 222/402.24 X |
| 3,385,482 | 5/1968 | Frangos | 222/402.24 X |
| 3,512,685 | 5/1970 | Ewald | 222/402.24 X |
| 3,620,421 | 11/1971 | MacGuire-Cooper | 222/402.24 X |
| 4,139,128 | 2/1979 | Ewald | 222/402.22 X |
| 4,150,522 | 4/1979 | Burger | 53/470 |

FOREIGN PATENT DOCUMENTS

| | | | |
|---|---|---|---|
| 740305 | 8/1966 | Canada . | |
| 765677 | 8/1967 | Canada . | |
| 868760 | 4/1971 | Canada . | |
| 878326 | 8/1971 | Canada | 222/402.1 |
| 915648 | 11/1972 | Canada . | |
| 8101695 | 6/1981 | PCT Int'l Appl. . | |
| WO82/533 | 8/1982 | PCT Int'l Appl. . | |
| 1054179 | 1/1967 | United Kingdom . | |
| 1232155 | 5/1971 | United Kingdom . | |
| 1426239 | 2/1976 | United Kingdom . | |
| 1463733 | 2/1977 | United Kingdom . | |
| 1499158 | 1/1978 | United Kingdom . | |
| 1597147 | 9/1981 | United Kingdom . | |
| 2089897 | 6/1982 | United Kingdom . | |

*Primary Examiner*—Charles A. Marmor
*Attorney, Agent, or Firm*—Christie, Parker & Hale

[57] ABSTRACT

A valve cup (60) for an aerosol dispensing can has a side wall (68) of lesser girth at the bottom than in an upper zone of which a portion is adapted to intensify the seal in the swaged seam between the cup curl (70') and the body curl (22). The side wall has for example a step (88) which acts as a fulcrum. In the swaged seam the seal is intensified in the area adjacent the step and down to a second point of contact where the side wall is deformed by the swaging tool (38) into contact with the body wall (1).

27 Claims, 2 Drawing Sheets

PRESSURIZABLE CONTAINERS

This application is a continuation of U.S. Application Ser. No. 133,242 filed Dec. 10, 1987, now abandoned, which is a continuation of U.S. Application Ser. No. 017,040 filed Feb. 19, 1987, now abandoned, which is a continuation of U.S. Application Ser. No. 728,743 filed Apr. 30, 1985 as PCT GB84/00289 on Aug. 20, 1984, now abandoned.

This invention relates to pressurisable dispensing containers of the kind comprising a hollow container body having a mouth defined by a terminal body curl (which term is to be understood to include a solid terminal bead) and a valve cup having a continuous side wall terminating in a peripheral cup curl, the valve cup being secured in the mouth by a seam wherein the cup curl is secured over the body curl by deformation of at least said side wall with a sealing medium at the interface between the two curls. Such a container will be called a "container of the kind specified".

The invention relates also to valve cups for containers of the kind specified; to methods of securing the valve cup to the container body, in the assembly of such a container; and to containers made by such methods.

A container of the kind specified is most commonly to be found in the well-known form of an aerosol dispensing container.

For convenience, the remainder of this Description will however be presented in terms of aerosol dispensing containers and valve cups thereof, it being understood that pressurisable dispensing containers also take other forms known in the art.

The resilient sealing medium at the interface conventionally takes any one of several forms. In the first of these forms, it is a separate gasket comprising a flanged sleeve-like manner, separately applied to the valve cup as an individual operation in manufacture of the cup. Its material is any one of a number suitable for making such a component, such as natural or synthetic rubber or elastomeric material. The material may for example be a polyolefin or a polyester. The second, more widespread, form of sealing medium consists of a layer of a suitable sealing compound applied by flowing it in liquid form on to the underside of the cup curl, and then cured to form a gasket which is solid but resilient. Typically the compound applied in this way is latex, having a thickness of 0.6 millimeter.

A recent development, providing an attractive alternative to both a separate gasket or a flowed-on type of gasket, and disclosed in our International Patent Application published under the number WO 81/01695 provides a valve cup (or other component of a can) which is made from a prelaminated sheet material comprising a polymeric layer bonded to a metal substrate layer. A seam joining two overlapping edge portions, which may be portions of the same component or of two components, has the polymeric layer of one edge portion facing the other edge portion. No separately applied sealing material is introduced between the overlapping edge portions, nor is any such material applied beforehand to either edge portion. At least one of the edge portions is deformed, for example by swaging or crimping, in such a way that the resulting seam consists of the metal substrate layers of the edge portions with, between them, the polymeric material compressed so as to provide the required sealing effect without any other material being present for this purpose. Such a seam provides a satisfactory pressure-retaining seal, as for example in the seam joining the valve cup to the body of an aerosol dispensing container.

In the commonly-used technique of swaging the valve cup to the container body the side wall of the cup is deformed so as to crimp a portion of the side wall hard against the corresponding wall portion of the body, immediately adjacent the root of the cup curl, whilst at the same time pressing a portion of the terminal flange towards the cup curl adjacent to the terminal edge of the former. The conventional tooling for this purpose comprises two co-operating tools, viz. (a) a fixed locating ring having a cylindrical opening, and (b) a collet which lies concentrically within the cylindrical opening and terminates in a set of fingers or chives for engaging the cup side wall, a mandrel being reciprocable axially in the collet.

In the high-speed manufacture of aerosol containers, the valve cups are placed on the bodies prior to swaging, using automatic feeding equipment, the requirements of which impose certain dimensional limitations upon both the unswaged valve cup and the body curl. The effect of these limitations is that, in the conventional swaging operation, the portion of the cup which is crimped hard against the container body represents the only portion that is in substantially intimate contact with the container body. The metal of the two curls is separated over the remainder of the swaged seam by a gap which is necessarily relatively large, and which is of course substantially (though not necessarily completely) filled by the sealing medium. The thickness of the sealing medium must be sufficient to enable this gap to be substantially filled. In general, using conventional components and the conventional swaging operation, it is accepted in the industry that this thickness must be, at the very least 0.2 millimeter if a reliable seal is to be assured. It often has to be much greater than this.

According to the invention, in a first aspect, in a valve cup for a container of the kind specified but prior to being secured to the container body, the upper zone of the side wall has at least one circumferentially extending discontinuity defining a relatively sharp local change in radius and providing a seal-promoting integral wall portion, whose girth is substantially greater than that of the lower zone at least adjacent the junction of the side wall with the bottom panel, whereby, upon subsequent deformation of the side wall to form a said seam, the sealing medium is forced, over an extended area at least in the region of said integral wall portion, to form between the curls a seal which is both intimate, and locally intensified as compared with the conventional arrangements described above which in general have no local intensification.

The commonest cross-section of a container of the kind under consideration being circular, its mouth is preferably circular so that the "girths" above-mentioned are circumferences. Thus with a circular valve cup according to the invention, the seal-promoting integral portion has a circumference greater than that of at least the lowest extremity of the side wall, i.e. immediately above its junction with the bottom panel. This contrasts with the conventional valve cup, the whole of the side wall of which is cylindrical, and of a diameter significantly smaller than the smallest internal diameter of the body mouth, so that the valve cup can easily be inserted when first placed upon the body.

It should be emphasized that the present discussion (including the above statement of invention) is concerned with the valve cup in the condition in which it exists as a separate component. Even a conventional prior art valve cup has part of its side wall deformed during swaging so that, when secured to the body, that part then has a greater diameter than the remainder of the side wall.

The, or each said discontinuity preferably comprises a peripherally-extending step whereby the girth of the side wall immediately above the step is greater than that immediately below it. Such a step defines an external shoulder where it joins the cylindrical portion above it. When the side wall is deformed, this shoulder (or at least the uppermost shoulder if there is more than one step) is forced against the adjacent internal surface of the body, which is preferably a portion of that surface at the root of the body curl.

A shoulder so forced against the internal body surface is part of the said seal-promoting integral wall portion. Below the step (or the uppermost step), part of the side wall is deformed radially outwardly during swaging, to provide a second very close peripheral line of engagement between the side wall and the internal body surface. Thus the seal-promoting integral wall portion here constitutes the shoulder of the uppermost step together with a portion of the side wall, of reduced diameter, just below that step. As compared with the prior art valve cup having a simple cylindrical side wall, which when deformed provides only a single peripheral line of close contact, there is thus achieved by the present invention an extended area of the internal body surface over which the sealing medium is forced to form an intimate seal between the body curl and the cup curl.

The invention enables the external diameter of the upper zone, at least in that part of the latter that is to lie level with the body curl, to be only very slightly smaller than the smallest internal diameter of the body curl. This leads to improve sealing integrity, whilst the seal-promoting integral wall portion, of greater circumference than the parts of the side wall below it, allows the thickness of sealing medium to be reduced. Another aspect of this is that, because the parts of the side wall below the seal-promoting integral wall portion are of smaller diameter than that portion, manufacturing tolerances in the diameter of circumference of those parts may still be kept relatively generous without introducing the risk of the cup becoming jammed in the body mouth during automatic placing of the cup in the body mouth.

It has been found (to take a random example) that, using a stepped valve cup according to the invention, a sealing effect at least as reliable as that obtainable with the conventional cup having a plain cylindrical side wall, is obtained with a separate sealing gasket, or a flowed-in latex sealing compound, having a thickness of 0.2 millimeter or less. This compares with the conventional sealing medium thickness greater than 0.2 millimeter as an absolute minimum. Where the valve cup according to this invention is of pre-laminated sheet comprising a polymeric layer bonded to a metal substrate, the polymeric layer constituting the only compressible sealing medium in the seam, a comparable degree of sealing integrity is obtained where the polymeric layer has a thickness no greater than 0.1 millimeter.

These advantages are also obtainable with a number of different embodiments of valve cup within the scope of the invention. For example, the seal-promoting integral wall portion may comprise at least one projection (preferably in the form of a radial bead) extending laterally outwards. In this case the portion of the side wall above the bead may be generally-cylindrical, or for example in the form of a draft taper convergent towards the bottom; and whichever of these shapes is adopted for that portion of the wall, the portion below the bead may take either of these forms also.

Where the side wall has at least one step, as discussed above, the lower zone may comprise a series of wall portions joined by steps whereby each of said wall portions is of lesser girth than that next above it. In this form each of the said wall portions may be generally-cylindrical, or in the form of a draft taper. In practice, in the former case it is convenient to make the side wall simply in the form of a series of cylindrical portions joined by steps, the uppermost one (or perhaps two) of these steps defining the seal-promoting integral wall portion.

According to the invention, in a second aspect, in a container of the kind specified, the valve cup is a valve cup in any desired form according to the invention in its first aspect, but with its side wall deformed so that, over an extended area at least in the region of the seal-promoting integral wall portion, the sealing medium is compressed so as to form an intimate and intensified seal between the curls of the seam.

Preferably, the valve cup side wall is so deformed that the seal-promoting integral wall portion is forced closely against the container body in at least two transverse planes spaced apart from each other.

Whilst the valve cup may be manufactured from prelaminated sheet material, so also, or alternatively, may at least that component of the container body that includes the body curl. The prelaminated sheet material comprises a metal substrate layer and a layer of a resilient polymeric material securely bonded to the substrate layer over at least that side of the latter which includes the surfaces of the container body in engagement with the valve cup, whereby the polymeric layer provides at least part of the sealing medium of said seam.

Preferably, whether the valve cup, or the container body, or both, comprises a said polymeric layer, the polymeric layer or layers will constitute the whole of the sealing medium in the seam, additional material for effecting adhesive contact between the valve cup and container body being absent.

Alternatively the layer of sealing material may be in the form of a discrete sealing gasket member.

According to the invention, in a third aspect, in the assembly of a container according to the invention in its said second aspect, a method of securing the valve cup to the hollow container body comprises the steps of: placing the valve cup on the container body with the terminal seaming flange of the valve curl overlying the body curl and with at least one of the curls having a layer of sealing material facing the other curl; and deforming at least the side wall of the valve cup, so as to form the seam securing the valve cup to the container body, and so as also to force the sealing material, over an extended area in the region of the integral wall portion of the valve cup, to form an intimate and intensified seal between the curls.

The deformation of the valve cup side wall is preferably effected by swaging. Where the cup has at least one step in its side wall, the radially-expandable swaging tool engages the upper zone of the cup side wall just below said at least one peripherally-extending step of the side wall, so as to force the step or steps against the body curl, and so as also to deform the side wall at the point of contact of the tool therewith and there form a bend, which is likewise forced by the tool against the body in a transverse plane spaced from the transverse plane or planes of contact of the step or steps with the body curl. On the other hand, if the seal-promoting integral wall portion of the cup comprises at least one lateral projection such as a bead, the tool engages the lower zone of the side wall, so as to deform the lower zone outwardly and thereby cause at least the integral wall portion to be deformed.

A container of the kind specified, having its valve cup secured to its container body by a method according to the invention, is included within the scope of the invention.

Various embodiments of the invention will now be described, by way of example only, with reference to the schematic drawings of this Application in which:

In FIGS. 6 to 10:

FIG. 6 illustrates a first embodiment of a valve cup;

FIG. 7 illustrates a preferred second embodiment, with the valve cup placed upon the container body prior to being secured thereto;

FIG. 8 shows the second embodiment after the valve cup has been secured to the container body;

FIG. 9 illustrates a third embodiment; and

FIG. 10 is a view similar to FIG. 8 but illustrating a fourth embodiment.

It should be emphasized that the drawings are somewhat schematic and that some dimensions are exaggerated for clarity.

Figure 1:
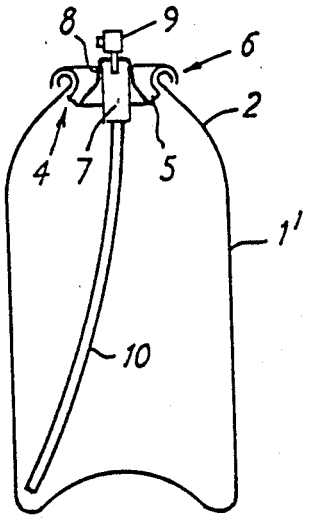
FIG. 1 PRIOR ART
FIG. 1 is a diagrammatic cross-sectional elevation of a typical aerosol dispensing container.

Referring first to FIG. 1, a pressurisable dispensing container, in the form of an aerosol can, comprises a hollow container (can) body 1' formed in one piece and having its upper portion re-formed into the shape of a dome 2. The dome 2 terminates in an outwardly-directed, generally-toroidal terminal body curl, which defines the mouth 4 of the can body 1'. The mouth 4 is closed by a valve cup 5 which has a side wall terminating in a peripheral cup curl. The valve cup 5 is secured to the can body 1', in the mouth 4, by a peripheral seam 6, in which the cup curl is secured over the body curl by deformation of the side wall with a sealing medium (not shown in FIG. 1) at the interface between the two curls. The valve cup 5 carries an aerosol dispensing valve 7 in a central valve housing 8 of the valve cup, the valve 7 having an upstanding stem which carries a dispensing button 9 for operating the valve to release its contents via a dip tube 10, the valve 7 and button 9. In use, the can 1 is filled with a suitable propellant compound and a product to be dispensed, both being under a pressure substantially higher than that of the atmosphere, so that when the valve actuating button 9 is depressed to open the valve 7, the product is driven out by the propellant.

Figure 2:
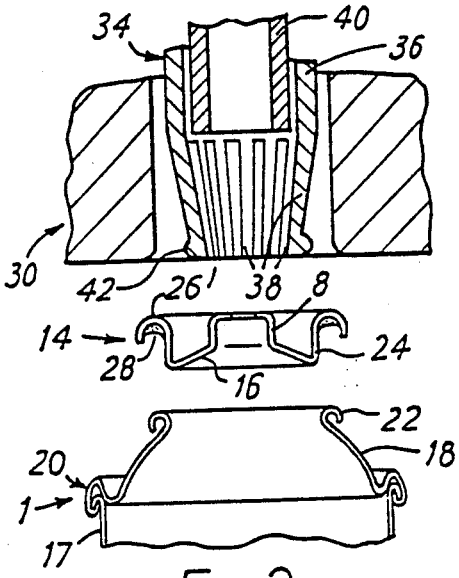
FIG. 2 PRIOR ART
FIG. 2 is a simplified cross-sectional elevation showing parts of a set of swaging tools, together with a valve cup and the other part of the container body, of an aerosol dispensing container, the last-mentioned components being shown in their condition prior to being secured together by means of the swaging tooling.
Figure 3:
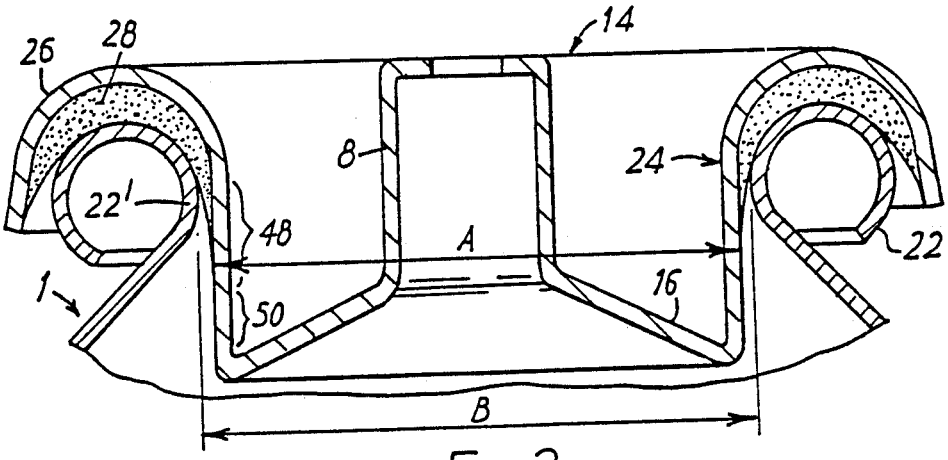
FIG. 3 PRIOR ART
FIG. 3 is a greatly enlarged sectional elevation, showing a conventional valve cup in position on the container body of an aerosol dispensing container, ready to be secured thereto.

FIG. 2 illustrates a conventional valve cup 14, which is also shown in FIG. 3. The valve cup 14 comprises a button panel portion 16, which is of a generally frusto-conical or slightly domed shape, and which has the integral, generallly-cylindrical valve housing 8 at its centre. The valve 7 and its dip tube 10 are normally assembled with the valve cup before the latter is secured to the can body; and it is to be understood that this is preferably the case in all of the examples to be described hereinafter. However, for simplicity, the valve and dip tube are omitted from all of the figures except FIG. 1.

FIG. 2 also illustrates the upper part of an aerosol can body 1 of the "built-up" kind, comprising a body cylinder 17 (which may have a separate bottom end member, not shown, seamed to it, or which may be formed integrally with its bottom end wall), and a dome 18 secured to the body cylinder by means of a peripheral double can seam 20 of the conventional kind. The dome 18 terminates at the top in the body curl, which is indicated by the reference numeral 22. In all of the examples described hereinafter, the can body may equally be of the one-piece kind or of a built-up kind. On this understanding the examples will for convenience be discussed with reference to the can body 1.

Reverting to FIGS. 2 and 3 together, the conventional valve cup 14 has a continuous side wall 24, in the form of a cylinder, upstanding from and integral with the periphery of the bottom panel portion 16 of the cup. The cylindrical side wall 24 terminates in a large seaming flange 26 which is curled radially outwardly and downwardly. A layer 28 of latex sealing compound, approximately 0.6 millimeter in thickness at its thickest part but decreasing in thickness towards its edges, is disposed upon the underside of the seaming flange 26 and extends a little way down the exterior surface of the cup side wall 24.

In operation, the valve cup 14 is made by forming a pressing from sheet metal, which in this example is of tinplate (steel) or aluminium, after which the latex layer 28 is applied in the conventional manner by flowing it on to the surface of the valve cup and then causing the latex to cure. The dispensing valve and dip tube are secured to the valve cup by crimping the valve housing 8 around the valve. Using conventional automatic equipment, the resulting valve cup assembly (which will hereinafter, for simplicity, be merely referred to as the valve cup) is placed upon the can body 1 so that the valve cup seaming flange 26 is resting, via the latex seaming layer 28, upon the body curl 22 of the can body. This condition is illustrated in FIG. 3.

FIG. 2 shows the can body 1 and valve cup 14 in the same juxtaposition, but in "exploded" form for clarity.

The can body, with the valve cup resting on it, is now moved to a position below a set of conventional swaging tooling 30, FIG. 2. The tooling 30 comprises a locating ring 32 with a swaging tool 34 arranged coaxially within it, the swaging tool 34 being axially reciprocable with respect to the locating ring by a small amount. The swaging tool 34 comprises a collet 36, having resilient swaging fingers or chives 38 and an internal mandrel 40, which is reciprocable radially within the collet 36 so as to expand the latter radially outwardly by forcing the chives 38 outwardly. The chives 38 have at their lower end suitably profiled projections 42 for deforming the side wall 24 of the valve cup in the manner illustrated in FIG. 5.

The locating ring 32 is moved downwards until it engages with the seaming flange 26 of the valve cup. This presses the seaming flange down against the body curl 22, and engages a curling shoulder 33 of the locating ring with the outside of the seaming flange 26, which is now referred to as the "cup curl".

Figure 5:
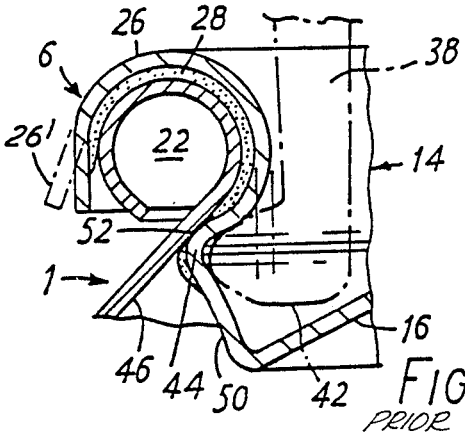
FIG. 5 PRIOR ART
FIG. 5 is a view similar to the left-hand part of FIG. 3, but showing the valve cup secured to the container body.
Figure 4:
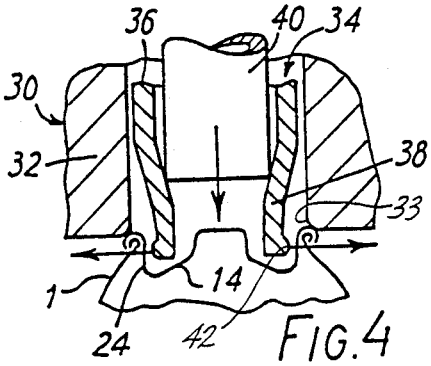
FIG. 4 PRIOR ART
FIG. 4 is a diagrammatic representation showing the operation of the swaging tooling of FIG. 2.

The collet 36 is not moved downwards to the position indicated in FIG. 4, in which the outward projections 42 lie facing the side wall 24 of the valve cup at a level just below the root, indicated at 22' in FIG. 3, of the body curl 22. The mandrel 40 is now forced downwards so as to force the projections 42 radially outwardly, as indicated in FIG. 4. The effect of this is illustrated in FIG. 5. The projections 42 deform the side wall 24 to form a radially outwardly-extending bead 44 which is in close engagement with the internal surface 46 of the can body just below the body curl 22.

The seam 6 (FIGS. 1 and 5) is now complete, and the mandrel 40 is raised so as to allow the chives 38 to retract, after which the swaging tool 34 is raised. Finally the locating ring 32 is released from contact with the now completed aerosol can.

It is convenient for the purposes of this Application to consider the valve cup side wall as comprising an upper zone and a lower zone, the upper zone being defined as that part which is in sealing engagement with the transversely-inner surface 46 of the body, up to the beginning of the cup curl, when the seam 6 has been formed. The lower zone comprises the remainder of the side wall. Thus, before the valve cup is secured to the can body, the upper zone is defined as the upper part of the cylindrical side wall 24 leading to the seaming flange 26, as indicated at 48 in FIG. 3; the lower zone being indicated at 50. This concept of an upper and a lower zone will be utilized in the examples, hereinafter to be described with reference to FIGS. 6 to 10, of embodiments of the invention.

In order to ensure ease of entry of the valve cup 14 into the mouth of the aerosol can, using automatic feeding equipment, it is conventional practice to provide that the external diameter A (FIG. 3) of the valve cup side wall is always significantly smaller than the smallest internal diameter B of the body curl 22. For this reason, close engagement between the valve cup and the can body occurs only along what is substantially circumferential line contact where the bead of deformation 44 is forced against the body surface 46, i.e. as indicated at 52 in FIG. 5. The whole of the remainder of the cup curl is spaced by a comparatively large distance from the body curl. Thus, not only is there only a single line of contact between the components, but the thickness of the sealing compound 28 must be generous enough to fill, substantially though usually not completely, the remaining, and substantial, space between the two curls 22 and 26, as has been previously discussed herein.

Reference is now made to FIG. 6 to 10. In each of the examples illustrated therein, the valve cup is secured to the can body using swaging tooling as alredy described, the only differences being that in some examples the radial projections 42 of the swaging tool chives engage different parts of the valve cup side wall as compared with other examples. The can body 1 is, in each of the examples illustrated in FIGS. 6 to 10, the same in all respects as the body 1 to which FIGS. 3 to 5 relate.

Figure 6:
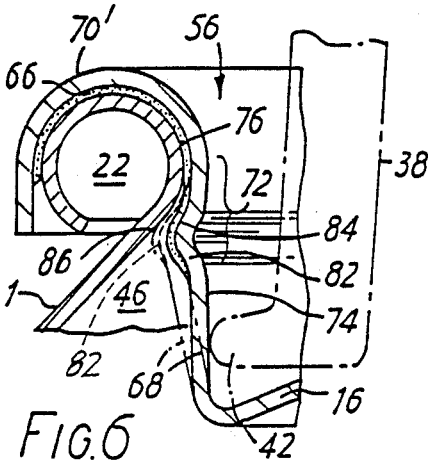
FIGS. 6 to 10 are all views similar to the left-hand part of FIG. 3, but showing instead various embodiments of the present invention, in each case a portion of the container body and valve cup of an aerosol dispensing container being depicted.
Figure 7:
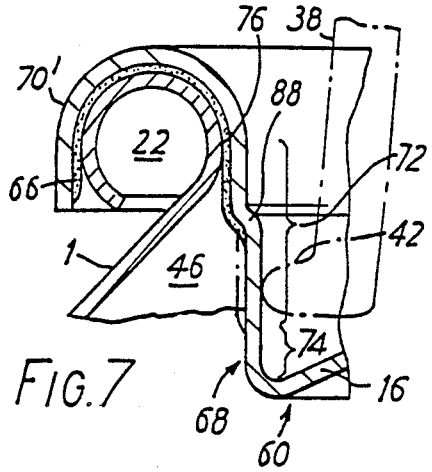
Figure 8:
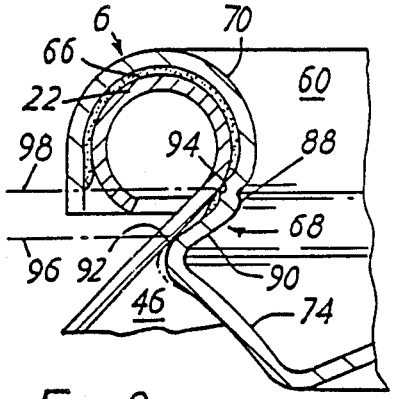
Figure 9:
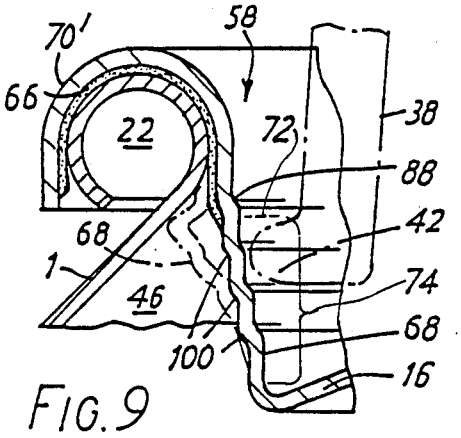

In each of FIGS. 6, 7 and 9 there is shown the relevant portion of a valve cup in its "as manufactured" state ready to be swaged to the can body. In each of these Figures, the respective valve cup comprises a bottom panel portion 16, a continuous side wall 68 upstanding from the periphery of the bottom panel portion, and a terminal seaming flange 70' for being secured, in the form of a cup curl (indicated at 70 in FIGS. 8 and 10), to the body curl 22. The side wall 68 in each case comprises an upper zone 72, for sealing engagement with the transversely-inner surface 46 of the can body and leading into the seaming flange 70'; and a lower zone 74 joining the upper zone 72 to the body panel.

It will be seen from the discussion hereinafter of the details of the embodiments shown in FIGS. 6 to 10 that, in each one, there is provided an increased area of very much closer proximity (between the metal of the valve cup and that of the can body 1 in, or in the region of, the body curl 22) than is the case in FIG. 5, without prejudicing the ability of the valve cup to enter into the mouth of the can body ready to be secured thereto.

Referring now to FIG. 6, in this embodiment the valve cup 56 has a generally-cylindrical side wall 68 having a pre-formed, circumferentially-extending radial bead 82 with a predetermined external profile 84. The bead 82 lies in the lower part of the upper region 72 of the side wall 68, and has an outer diameter such that the valve cup can readily be inserted into the mouth of the can body 1. The projections 42 of the swaging tool chives 38 are engaged with the lower region 74 of the valve cup side wall, so as to force the latter radially outwardly such as to force the bead 82 indirectly against the adjacent inner surface 46 of the can body without itself being severely deformed by the swaging tool. The profile 84 of the bead 82 is preferably so chosen as to lie closely against the surface 46 over an extended area, as indicated in phantom lines in FIG. 6.

Thus, in the embodiment of FIG. 6, the pre-formed bed 82 constitutes the seal-promoting integral portion of the valve cup side wall. A layer 66 of sealing compound is pre-applied over the underside of the seaming flange 70' and extends over the bead 82, as shown in FIG. 6.

In a modification (not shown) of the valve cup of FIG. 6, the side wall 68 is downwardly convergent between the lower end of the seaming flange 70' at point 76 and the bead 82, with the external diameter of the sidewall 68 at point 76 substantially equal to the internal diameter of the body curl.

The side wall diameter at the point 76 will in practice be so chosen that the exposed surface of the sealing compound layer 66 has a diameter either exactly equal to that of the body curl 22, or very slightly less. In the latter case there is a barely significant clearance at the point 76 between the sealing compound and the body curl when the valve cup is inserted into the mouth of the can body 1. Alternativley there may be a very slight interference fit between the sealing compound layer and the body curl at the point 76, such as to compress the latex slightly but not being sufficient to prevent the valve cup from being readily pushed fully home in the can body mouth by automatic feeding equipment.

The inside diameter of the free end of the seaming flange is approximately equal to (but not less than) the greatest external diameter of the body curl 22. Similarly, the radius of the seaming flange 70' is so chosen that the radius of the exposed surface of the layer 66 is substantially equal to that of the body curl 22, subject to there being a barely significant clearance or a very slight interference between the layer 66 and body curl 22.

The provision of the pre-formed, profiled bead 82 intensifies the seal in the localised region of this bead. This thickness of the layer 66 is preferably no greater than 0.2 mm.

Further modifications to the arrangement shown in FIG. 6 are possible. For example, the lower zone 74 of the side wall may be downwardly convergent, for example in the form of a draft taper. In place of a single continuous bead 82, there may be a single interrupted or segmented bead. There may be more than one continuous or segmented ridge, preformed one above the other in the side wall. The profile of the bead surface 84 may take any convenient form; for example it may extend up to the point 76, so that in effect the bead 82 is a continuation of the seaming flange 70', such that, after the swaging operation has taken place, the distance between the upper region 72 of the side wall and the body surface 46 gradually decreases over the area from the point 76 to the point of closest contact, 86, between the bead 82 and the surface 46.

It should be noted that, in an approach such as that described with respect to FIG. 6, employing a portion or portions of the valve cup side wall profiled to conform (after being swaged) with the adjacent body surface, such portion or portions must lie above the part of the side wall engaged by the swaging tool.

Reference is now made to FIG. 7, in which the side wall 68 of the valve cup, 60, is generally-cylindrical; at an intermediate position in its upper zone 72, it has a peripherally-extending step 88, at a level such as to lie opposite the lower part of the body curl 22. The step 88 extends radially inwardly from the part of the side wall 68 immediately above it (so that the lower side wall zone 74 is of smaller diameter). The upper zone 72 is again considered as terminating at the point 76 which represents the level of the smallest internal diameter of the body curl 22. The dimensions of the seaming flange 70', from the point 76 to the free edge of the flange, are generally as already described with reference to FIG. 6, so that the sealing effect is intensified over the whole of the cup curl after the swaging operation as compared with the conventional arrangement of FIG. 5 with its comparatively large radial distance between the cup curl and body curl.

The sealing layer 66, of latex or other suitable sealing compound, is again provided. Its thickness preferably does not exceed 0.2 millimeter, and it extends over the whole of the underside of the seaming flange 70', and over the exterior surface of the valve cup side wall 68 at least to a level just below the step 88. As indicated in phantom lines in FIGS. 7 and 8, the sealing layer 66 may cover the whole depth of the upper zone 72 of the side wall.

In the swaging operation, the radial projections 42 of the swaging tool chives are engaged with the upper zone 72, but below the step 88 as indicated in FIG. 7. FIG. 8 shows the final shape of the side wall 68 after swaging. It will be seen that the step 88 acts as a hinge or fulcrum, about which the portion 90 of the side wall immediately below it is bent outwardly by the chives 38. The side wall portion 90 is forced against the body surface 46 at a point 92, below which the wall is again bent so that its lower zone 74 then extends at approximately a right angle to the surface 46, so providing substantially the maximum possible compressive force urging the side wall at the point 92 into close sealing engagement with the wall of the can body 1.

The action of the swaging tool also has the effect of forcing the external shoulder 94 of the step 88 against the body surface 46. At the same time, as can be seen from FIG. 9, since the fulcrum effect of the step is to a certain extent achieved by bending at both its ends, the step becomes somewhat flattened. Thus the side wall portion 90 lies very close to the surface 46. The overall result is that there is an extended area, from the point of contact 92 to a level above the point of contact 94, in which the seal made by the sealing layer 66 is intensified. Thus, by virtue of the integral step 88, and of the wall portion 90 defined by applying the swaging tool at a level below the step 88, intensification of the seal is obtained in the extended region of the interface between the can body 1 and valve cup 60 lying between the two transverse or horizontal planes 96 and 98 (FIG. 9) which contain the respective points of contact 92 and 94.

Again, a number of modifications to the "stepped" form of the valve cup 60 are possible. For example, more than one step may be provided above the level at which the chive projections 42 are to engage the side wall 68. This will have the effect of providing an additional point or points of contact below, but functionally similar to, the point 94 and above the point 92; the seal may be thus further intensified.

A further modification is to make the lower zone 74 of the side wall in a generally downwardly-convergent form. This may for example be achieved by making it frusto-conical, i.e. in the form of a draft taper.

Another form which the convergent, stepped side wall may take is illustrated in FIG. 9. Here the side wall, below the uppermost step 88, is in the form of a series of generally-cylindrical wall portions joined by further steps 100. Such a form of construction minimises the risk of unintentional distortion of the metal, for example by wrinkling. However each of the wall portions joined by the steps 100 may be made downwardly-convergent, for example frusto-conical. Another variation is to give the lower zone 74, or the whole of the side wall below the step 88, circumferentially-extending corrugations.

Figure 10:
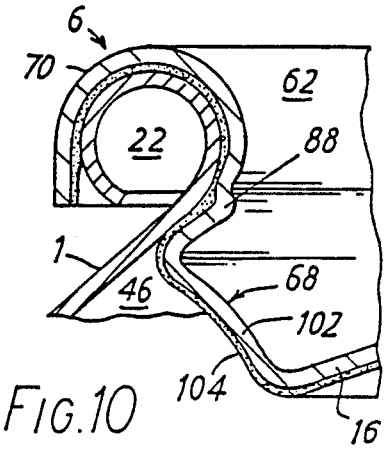

An alternative to the use of a pre-applied conventional sealing layer 66 is illustrated in FIG. 10. Whilst FIG. 10 illustrates this modification when applied to a valve cup of the same configuration as that of FIGS. 7 and 8, it is to be understood that the modification may equally well be applied to any of the other embodiments of the invention. This modification consists in substituting for a metal valve cup having a pre-applied sealing layer, or for a metal valve cup and separate gasket, a valve cup made of pre-laminated material.

Referring therefore to FIG. 10, the valve cup 62 shown therein is made from pre-laminated sheet material comprising a metal substrate layer 102, of steel (tinplate) or aluminium, and a layer 104 of a resilient polymeric material, in this example polypropylene. The polymeric layer 104 is securely bonded to the substrate layer 102 over the side of the latter, i.e. the underside, which includes the surfaces facing the surface 46 of the can body, so that on the underside of the valve cup 62 the metal substrate layer engages the body curl 22 through the polymeric layer 104, which in this example provides the whole of the sealing layer in the seam.

The thickness of the polypropylene layer 104 is no greater than 0.2 millimeter, and in this example it is 0.1 millimeter.

The can body 1, or the dome 18 (FIG. 2) may be made from pre-laminated sheet in the manner abovementioned. In such a case the valve cup may be made from plain metal, the polymeric layer of the can body then serving exactly the same purpose as the layer 104 in FIG. 10. Alternatively, if both of the components have such layers, then these two layers will together constitute the sealing medium in the seam. It is however to be understood that when either component is of such pre-laminated material, then preferably no other sealing medium is introduced into the seam.

I claim:

1. A valve cup for, but prior to being assembled into, a pressurisable dispensing container, for securing in a mouth having a hollow body with a terminal curl defining said mouth, which after assembly of the container is closed by said cup which then comprises a bottom panel, an endless side all upstanding from the periphery of said bottom panel, and a terminal cup curl secured over the body curl with a sealing medium at the interface between the two curls which constitute a seam, wherein the valve cup prior to said assembly comprises said bottom panel, said side wall, and a terminal seaming flange which is to provide after said assembly said cup curl, the side wall comprising a deformable upper zone for sealing engagement with a transversely-inner surface of the body and leading into said seaming flange, and a lower zone joining the upper zone to said panel, said deformable upper zone having a discontinuity extending around the whole circumference of the side wall and located adjacent the root of the seaming flange to define a relatively sharp local change in radius, and for providing a seal-promoting integral wall portion having a girth significantly greater than that of any part of the lower zone, whereby, upon subsequent deformation of the side wall during assembly to form a said seam, the sealing medium is forced, over an extended area at least in the region of said integral wall portion, to form an intimate and locally intensified seal between the curls.

2. A valve cup according to claim 1, wherein said discontinuity comprises an endless peripherally-extending step whereby the girth of the side wall immediately above the step is greater than that anywhere below it.

3. A valve cup according to claim 1, wherein the seal-promoting integral wall portion comprises an endless radial bead extending laterally outwards.

4. A valve cup according to any one of the preceding claims and made of pre-laminated sheet material comprising a metal substrate layer and a layer of a resilient polymeric material securely bonded to the substrate layer over at least that side of the latter which includes the surfaces of the valve cup adapted to engage a said body curl, whereby the polymeric layer provides at least one part of the sealing medium of said seam.

5. A valve cup according to claim 4, wherein the polymeric material is polypropylene.

6. A valve cup according to claim 4, wherein the polymeric layer has a thickness no greater than 0.2 millimeter.

7. A valve cup according to claim 4, wherein the metal substrate layer is of steel, tinplate or aluminum.

8. A valve cup according to claim 1 made of steel or aluminum and having a layer of sealing material applied to the surface of the seaming flange and side wall for engagement with a said body curl.

9. A valve cup according to claim 8, wherein the thickness of the applied layer of sealing material is no greater than 0.2 millimeter.

10. A valve cup according to claim 2 made of steel or aluminum and having a layer of sealing material applied to the surface of the seaming flange and side wall for engagement with a said body curl.

11. A valve cup according to claim 3 made of steel or aluminum and having a layer of sealing material applied to the surface of the seaming flange and side wall for engagement with a said body curl.

12. A pressurisable dispensing container comprising a hollow body with a terminal body curl defining a mouth and a valve cup comprising a bottom panel, an endless side wall upstanding from the periphery of said panel, and a terminal cup curl is secured over the body curl with a sealing medium at the interface between the two curls, to constitute therein a seam, the side wall comprising an upper zone sealingly engaged with a transversely-inner surface of the body and leading into the cup curl, and a lower zone joining the upper zone to said panel, the valve cup being a cup according to claim 1 but with its side wall deformed so that, over an extended area at least in the region of the seal-promoting integral wall portion, the sealing medium is compressed so as to form between the curls an intimate and intensified seal in which the sealing medium is then squeezed more than elsewhere along the seam.

13. A container according to claim 12, wherein the seam is a swaged seam, the extended region of the intensified seal being defined by deformation of the seal-promoting integral wall portion of the valve cup adjacent to where the valve cup side wall diverges from contact with the body.

14. A container according to claim 12 wherein an endless discontinuity of the upper zone of the cup side wall comprises at least one peripherally-extending step whereby the girth of the side wall immediately above the step is greater than that anywhere below it, the side wall being so deformed that the seal-promoting integral wall portion is forced closely against the body in at least two transverse planes spaced apart from each other.

15. A container according to claim 12, wherein the seal-promoting integral wall portion of the valve cup comprises an endless projection extending laterally outwards, the side wall being so deformed that the said integral wall portion is forced closely against the body in at least two transverse planes spaced apart from each other.

16. A container according to claim 12, wherein the valve cup is made from prelaminated sheet material comprising a metal substrate layer and a layer of a resilient polymeric material securely bonded to the substrate layer over at least that side of the latter which includes the surfaces of the cup engaging the body curl, said polymeric material constituting the whole of the sealing medium in the seam, additional material for effecting adhesive contact between the valve cup and container body being absent.

17. A container according to claim 12 wherein the sealing medium comprises a single applied layer of sealing material at the interface between the cup curl and the body curl, both curls being of metal, and the thickness of the layer of sealing material being no greater than 0.2 millimeter.

18. A method of securing the valve cup to the hollow container body in the assembly of a container according to claim 12, the method comprising the steps of: placing the valve cup on the container body (1) with the cup curl overlying the body curl and with at least one of the curls having a layer of sealing material facing the other curl; and deforming at least the side wall of the valve cup, so as to form the seam securing the valve cup to the container body, wherein the step of deforming the side wall comprises squeezing the sealing material most severely over an extended area in the region of the integral wall portion of the valve cup, to form between the curls an intimate and intensified seal in which the sealing medium is then squeezed more than elsewhere along the seam.

19. A method according to claim 18, wherein the deformation of the cup side wall is effected by swaging tooling including a radially outwardly-expandable swaging tool overlying the bottom panel of the valve cup, the swaging tool in the said step being expanded outwardly to engage a portion of the side wall below the discontinuity and so to deform at least the discontinuity to form the seal-promoting integral wall portion.

20. A method according to claim 19, wherein (a): in the valve cup, said discontinuity comprises an endless peripherally-extending step whereby the girth of the side wall immediately above the step is greater than that anywhere below it, and (b) the swaging tool engages the cup side wall just below said step so as to force the step against the body curl, and so as to deform the side wall at the point of contact of the tool therewith and there form a bend, which is likewise forced by the tool against the container body in a transverse plane spaced from the transverse plane of contact of the step with the body curl.

21. A method according to claim 19, wherein: (a) in the valve cup, said integral wall portion comprises an endless radial bead extending laterally outwards, and (b) the swaging tool engages the lower zone of the side wall, so as to deform the lower zone outwardly and thereby cause at least said integral wall portion to be deformed.

22. A container according to claim 13 wherein the sealing medium comprises a single applied layer of sealing material at the interface between the cup curl and the body curl, both curls being of metal, and the thickness of the layer of sealing material being no greater than 0.2 millimeter.

23. A container according to claim 14 wherein the sealing medium comprises a single applied layer of sealing material at the interface between the cup curl and the body curl, both curls being of metal, and the thickness of the layer of sealing material being no greater than 0.2 millimeter.

24. A container according to claim 15 wherein the sealing medium comprises a single applied layer of sealing material at the interface between the cup curl and the body curl, both curls being of metal, and the thickness of the layer of sealing material being no greater than 0.2 millimeter.

25. A container according to claim 16 wherein the sealing medium comprises a single applied layer of sealing material at the interface between the cup curl and the body curl, both curls being of metal, and the thickness of the layer of sealing material being no greater than 0.2 millimeter.

26. A valve cup for, but prior to being assembled into, a pressurisable dispensing container, such container comprising:

(a) a hollow body with a terminal body curl defining a mouth, and (b) a valve cup secured over the mouth and comprising, after being so secured, a bottom panel, an endless side wall upstanding from the periphery of said panel, and a terminal cup curl secured over the body curl with a sealing medium at the interface between the two curls to constitute therebetween a seam, the side wall comprising an upper zone sealingly engaged with a transversely-inner surface of the body and forming part of the cup curl, and a lower zone joining the upper zone to said panel, the valve cup, prior to being so secured, comprising:

(1) a bottom panel;

(2) a terminal seaming flange for securing over the body curl;

(3) an endless side wall upstanding from the periphery of said panel, the side wall constituting a deformable upper zone, leading into the seaming flange for sealing engagement with said inner surface of the body, and a lower zone joining the upper zone to said panel;

(4) the upper zone of the side wall having a discontinuity extending over the whole circumference of the side wall;

(5) the discontinuity being located adjacent the root of the seaming flange to define a relatively sharp change in radius;

(6) the maximum girth of the discontinuity being significantly greater than that of the lower zone, so that the discontinuity provides a seal-promoting integral wall portion;

whereby, on subsequent deformation of the side wall to form the seam, by application of an outward radial force to the side wall at least below the discontinuity, the sealing medium, which is present at the interface during the deformation, is forced over an extended area at least in the region of said integral wall portion, to form between the curls an intimate and locally intensified seal in which the sealing medium is then squeezed more than elsewhere along the seam.

27. A method for securing a valve cup to a container body wherein the container, prior to being assembled as a pressurisable dispensing container, comprises a hollow body with a terminal body curl defining a mouth and a valve cup secured over the mouth and comprising, after being so secured, a bottom panel, an endless side wall upstanding from the periphery of said panel, and a terminal cup curl secured over the body curl with a sealing medium at the interface between the two curls to constitute therewith a seam, the side wall comprising an upper zone sealingly engaged with a transversely inner surface of the body and forming part of the cup curl, and a lower zone joining the upper zone to said panel; and in which the valve cup, prior to being so secured, comprises a bottom panel; a terminal seaming flange for securing over the body curl; an endless side wall upstanding from the periphery of said panel, the side wall constituting a deformable upper zone leading into the seaming flange for sealing engagement with said inner surface of the body, and a lower zone joining the upper zone to said panel; the upper zone of the side wall having a discontinuity extending over the whole circumference of the side wall; the discontinuity being located adjacent the root of the seaming flange to define a relatively sharp change in radius; the maximum girth of the discontinuity being significantly greater than that of the lower zone so that the discontinuity provides a seal-promoting integral wall portion;

the method comprising the steps of:

placing the valve cup on the container body with the seaming flange overlying the body curl and with at least one of the flange and curl having a layer of sealing material facing the other of the flange and curl; and deforming at least the side of the valve cup to form the seam by applying an outward radial force to the side wall, the application of the radial force being at least below the discontinuity, thereby squeezing the sealing material, most severely over an extended area in the region of the integral wall portion, to form an intimate and intensified seal between the curls.

* * * * *